US007458928B2

(12) United States Patent
Carson et al.

(10) Patent No.: US 7,458,928 B2
(45) **Date of Patent: *Dec. 2, 2008**

(54) CENTRIFUGE ENERGY MANAGEMENT SYSTEM AND METHOD

(75) Inventors: David M. Carson, Newtown, CT (US); Vijay Mehta, Bethel, CT (US); Harvey Schneider, Southbury, CT (US)

(73) Assignee: Kendro Laboratory Products, LP, Newtown, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/441,120

(22) Filed: May 20, 2003
(Under 37 CFR 1.47)

(65) Prior Publication Data

US 2004/0033878 A1 Feb. 19, 2004

Related U.S. Application Data

(63) Continuation of application No. 60/387,916, filed on Jun. 13, 2002.

(51) Int. Cl.
*B04B 9/10* (2006.01)

(52) U.S. Cl. ..... 494/37; 73/865.9; 210/145; 210/739; 494/7; 494/8; 494/9; 494/10

(58) Field of Classification Search ..... 494/1, 494/7–11, 37, 84; 210/143, 149, 739, 787, 210/145; 318/798, 806; 388/923, 930, 903, 388/904; 73/116, 865.9; 422/72; 436/177
See application file for complete search history.

(56) References Cited

U.S. PATENT DOCUMENTS 4,244,513 A * 1/1981 Fayer et al. ..... 494/10
4,700,117 A * 10/1987 Giebeler et al. ..... 388/814
4,827,197 A * 5/1989 Giebeler ..... 318/3
4,903,191 A 2/1990 Fries
5,235,864 A 8/1993 Rosselli et al.
5,431,620 A 7/1995 Schenck et al.
5,467,001 A 11/1995 Iwashita
5,509,881 A 4/1996 Sharples
5,600,076 A 2/1997 Fleming et al.
5,650,578 A * 7/1997 Fleming et al. ..... 73/865.9
5,721,676 A * 2/1998 Bolden et al. ..... 700/3
5,752,910 A * 5/1998 Cheng ..... 494/7
5,800,331 A 9/1998 Song
5,837,879 A 11/1998 Zick
6,143,183 A * 11/2000 Wardwell et al. ..... 210/739
6,204,627 B1 3/2001 Watanabe et al.
6,205,405 B1 3/2001 Pouvreau
6,368,265 B1 * 4/2002 Barkus et al. ..... 494/8
6,649,905 B2 * 11/2003 Grenlund ..... 250/227.14
6,679,820 B2 1/2004 Barkus et al.
6,747,427 B1 6/2004 Carson
6,943,509 B2 9/2005 Schneider et al.

FOREIGN PATENT DOCUMENTS

GB 2126358 * 3/1984

* cited by examiner

*Primary Examiner*—Joseph W Drodge
(74) *Attorney, Agent, or Firm*—Baker & Hostetler LLP

(57) ABSTRACT

A method and apparatus for a centrifuge energy management system prevents the energy level of a rotor from exceeding a predetermined containment limit for the centrifuge by monitoring the energy level and either terminating a run operation of the centrifuge if it surpasses the containment limit or reducing the rotational speed of the rotor.

22 Claims, 4 Drawing Sheets

CENTRIFUGE ENERGY MANAGEMENT SYSTEM AND METHOD

PRIORITY

This application claims priority to the provisional U.S. patent application entitled, Centrifuge Energy Management System, filed Jun. 13, 2002, having a Ser. No. 60/387,916, the disclosure of which is hereby incorporated by reference.

FIELD OF THE INVENTION

The present invention relates generally to energy management systems. More particularly, the present invention relates to utilizing a centrifuge energy management system and a method to calculate the energy level of a centrifuge rotor in order to reduce the risk of exceeding a containment limit of the centrifuge and to limit the amount of energy that is applied to the centrifuge by a user entry error.

BACKGROUND OF THE INVENTION

A centrifuge instrument is a device by which contained materials of different specific quantities are subjected to centrifugal forces in order to separate colloidal particles suspended in a liquid. A typical centrifuge set-up may include a centrifuge tube which holds a sample for separation. A plurality of centrifuge tubes may be located and retained on a rotor of the centrifuge. The rotor of the centrifuge is commonly configured to be contained in a compartment and spun about a central axis in order to achieve separation of the sample. A rotatable drive shaft may be connected to the centrifuge rotor in order to facilitate spinning of the rotor assembly. The rotatable drive shaft may be further connected to a source of motive energy in order to receive power.

Centrifuges are currently employed in many industrial and research situations, such as, for example, laboratories. Laboratory centrifuges are generally operated by manual controls using various settings and procedures. The calibration of the centrifuge is important in order to achieve proper separation of particles within test samples during testing under controlled operating conditions. An operator may want to pre-set various aspects of the testing condition or indicated specific components coupled to the system of the centrifuge. This information could be further conveyed to a processor located within the centrifuge and be utilized for preparing the centrifuge to operate under a prescribed testing condition.

An example of relayed information that can set up a condition of the centrifuge may include a rotor control used to set the specific size or type of rotor used within the centrifuge. This would allow the centrifuge to operate a given rotor assembly at preferred power levels. Different rotors are capable of operating at different speeds and are further capable of generating different centripetal forces. Such control would be preferable in order to operate a given rotor at peak efficiency and prescribed rotational forces and/or speeds.

An operator may also want to apply the centripetal force generated by the rotor over a regulated time period. This, of course, would depend on the goals for testing a product and the test sample itself. Additional controls may also include conventional power switches provided on the centrifuge device to manually turn the unit on or off as needed. Thus, it is clear that the ability to control functions of the centrifuge can be advantageous to a user and the samples being tested. Having a greater flexibility to control the testing environment would yield a greater variety of functions in the testing capabilities provided by the centrifuge.

While technological advances have made it easier to calibrate and control operations of the centrifuge, there remain some areas of calibration which could be refined in order to improve not only the overall operational control of the centrifuge but also improve the safety aspects of the device during use. For instance, it is widely known that the inherent design of the rotor generates very large centripetal forces during operation. Ideally, the compartment in which the rotor is contained should be designed to retain any loose components if, for instance, a test sample were to become dislodged from the rotor or if the rotor were to become separated from the rotatable drive shaft in operation. However, in rare instances, it may be possible, if the rotational energy is high enough, for the pieces of the failed centrifuge rotor to breach the compartment or cause excessive movement of the centrifuge. Thus, as another precaution, it would be advantageous to realize any containment limits of a centrifuge and purpose to not exceed this limit valve. Another precaution would be to check that the energy of the centrifuge rotor is within a predetermined range for the rotor.

SUMMARY OF THE INVENTION

It is therefore a feature and advantage of the present invention to provide a method of centrifuge energy management including calculating an energy level of a centrifuge rotor at a predetermined speed, comparing the calculated energy level to a predetermined maximum containment level for the centrifuge, or an energy range of a set centrifuge rotor, and terminating a centrifuge run or reducing a rotational speed of the centrifuge rotor, if the calculated energy level exceeds the predetermined maximum containment level or the energy range of the set centrifuge rotor.

In another aspect of the invention a centrifuge energy management system is provided which includes a means for calculating an energy level of a centrifuge rotor at a predetermined set speed, a means for comparing the calculated energy level to a predetermined maximum containment level for the centrifuge, a means for comparing the calculated energy level to an energy range of a set centrifuge rotor, and a means for terminating a centrifuge run or means for reducing a rotational speed of the centrifuge rotor, if the calculated energy level exceeds the predetermined maximum containment level or the energy range of the set centrifuge rotor or the energy range of the set centrifuge rotor.

In another aspect of the invention, a separation device is provided which includes a centrifuge having system components and a rotor. The device may also include a centrifuge energy management system comprising a processor that calculates an energy level of the rotor at a predetermined set speed, compares the calculated energy level to a predetermined maximum containment level for the centrifuge or an energy range of a set centrifuge rotor, and either terminates a centrifuge run or reduces a rotational speed of the rotor if the calculated level exceeds the predetermined maximum containment level or the energy range of the set centrifuge rotor.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE INVENTION

The present invention utilizes a centrifuge energy management system to calculate the energy level of the rotor and to reduce the risk of exceeding the rotor containment limits by not allowing any rotor to be driven past its predetermined, proven containment limit. In addition, the system is capable of comparing a calculated energy level of a rotor to an expected energy range for a set rotor and alert the user of an error if the calculated energy falls outside the expected range. This enhances safety and preserves the structural integrity of the centrifuge device and aids in the prevention of user input errors.

Figure 1:
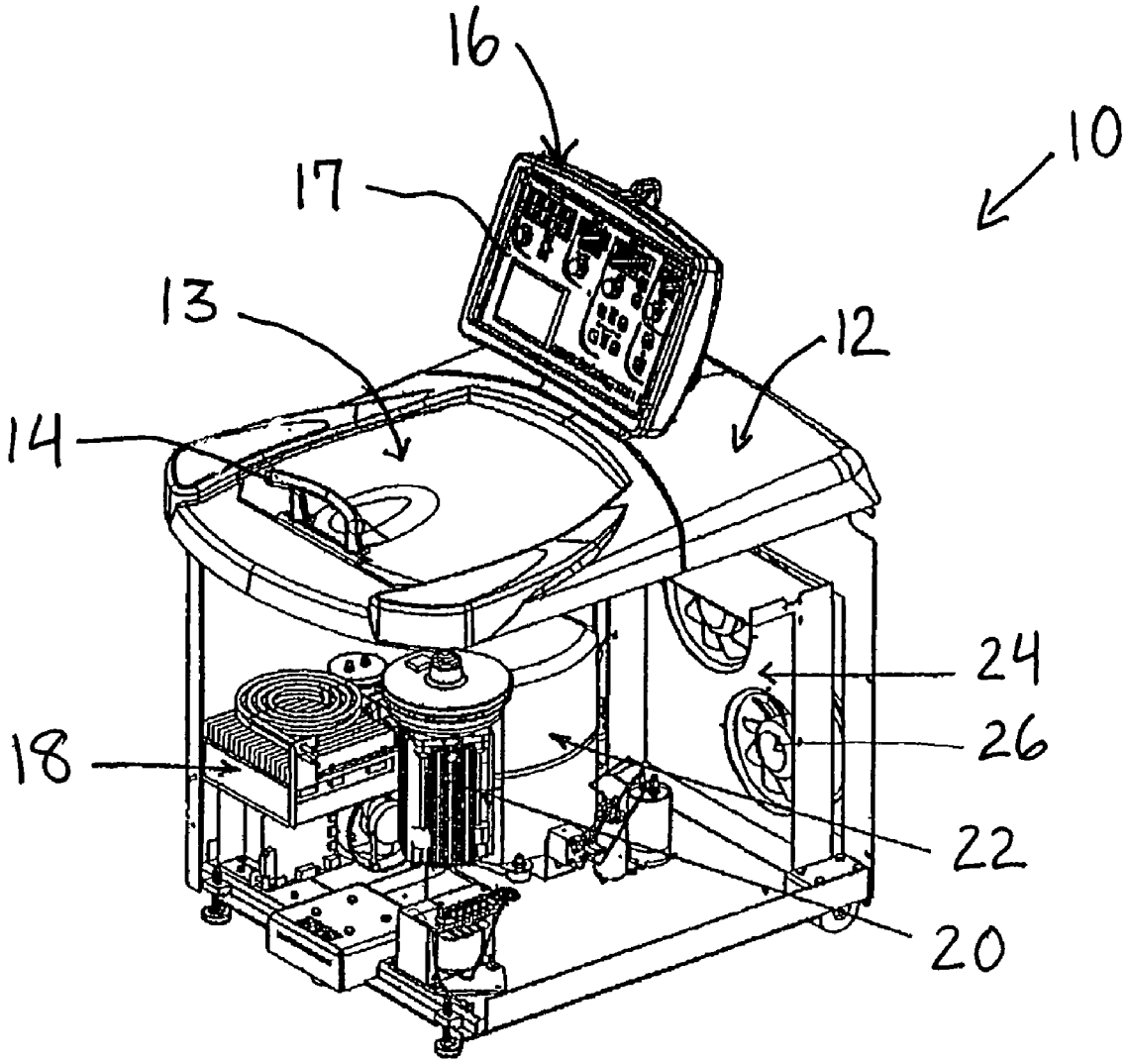
FIG. 1 is a perspective view of a centrifuge in accordance with one preferred embodiment of the invention.

A preferred embodiment of the present invention will now be described with reference to the drawing figures, in which like reference numbers refer to like elements throughout. Referring to FIG. 1, a centrifuge 10 includes a centrifuge housing 12 which encapsulates various hardware systems of the centrifuge 10. Connected to the centrifuge housing 12 is a control console 16. The control console 16 may be tiltably adjustable with respect to the centrifuge housing 12 in order to accommodate various operators in different positions relative to an interface 17 of the control console 16. The control console 16 may also contain a processor that performs the calculations as described herein. The processor may be any of a wide variety of computers, such as those utilizing a CPU and associated electronics.

Access to the centrifuge chamber may be gained through the door 12, and can be achieved by simply sliding the handle 14 back towards the control console 16. The internal components of the centrifuge 10 may include a variety of hardware components. A major purpose of such components would allow the centrifuge 10 to subject test samples to centrifugal forces. An additional purpose of the centrifuge components may include regulating the operating temperature of test samples. For example, a drive motor 20 is controlled by drive motor power electronics 18. The drive motor may power the electronics 18 including, for example, a processor that performs the calculations as described herein. The processor may be any of a wide variety of computers, such as those utilizing a CPU and associated electronics. Additional system components may include a refrigeration compressor 22, a refrigeration condenser 24 and cooling fans 26.

Figure 2:
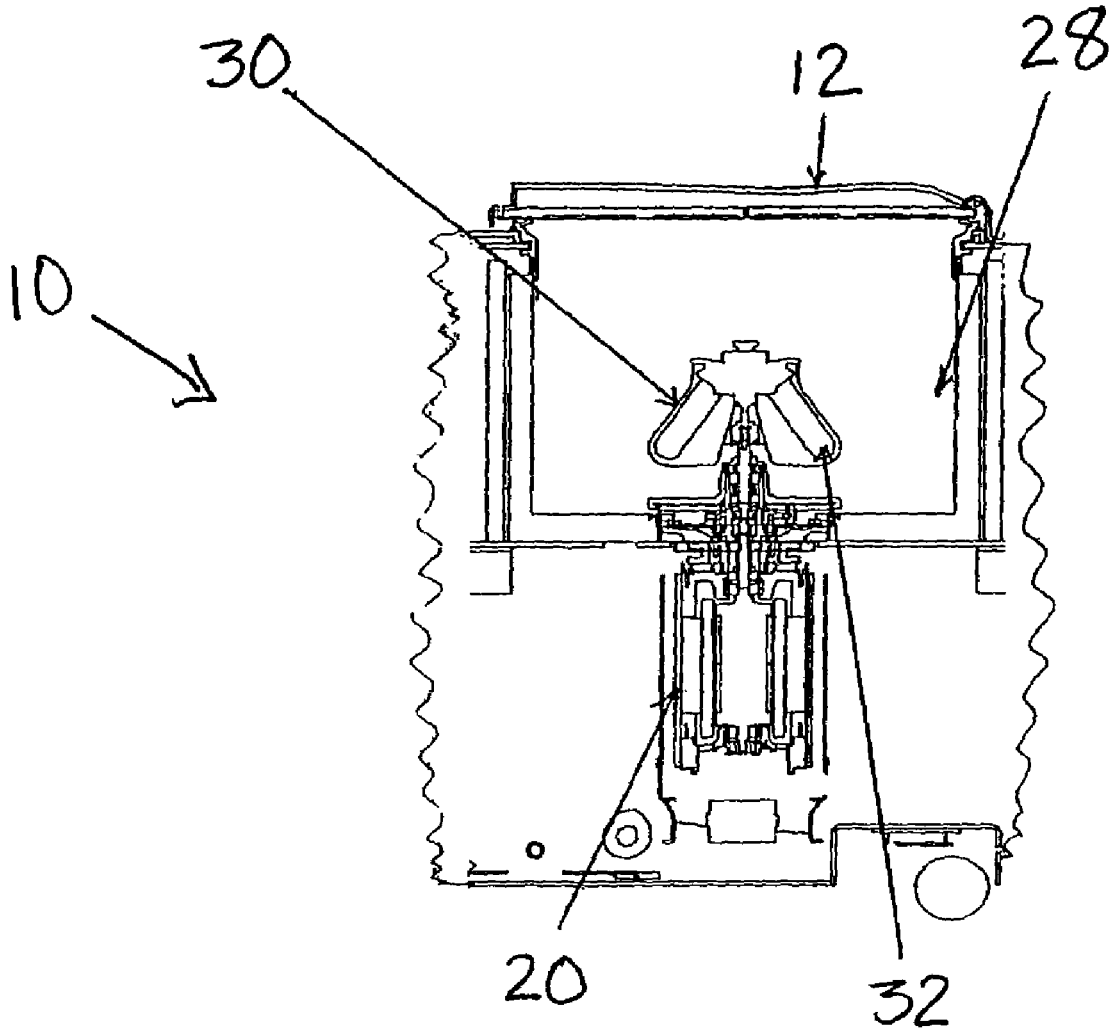
FIG. 2 is an internal layout view of the centrifuge shown in FIG. 1.

FIG. 2 illustrates additional hardware components of the centrifuge 10. A centrifuge chamber 28 contains a centrifuge rotor 30 which is further connected to a drive motor 20. The centrifuge rotor 30 is capable of retaining centrifuge tubes 32. The centrifuge tubes 32 hold test samples to be subjugated to the separation process. In operation, the centrifuge rotor 30 is configured to be contained in the centrifuge chamber 28. The centrifuge tubes 32 (containing test samples) may be spun about a central axis, via centrifuge rotor 30, to achieve separation of the sample.

A preferred embodiment of the invention provides an energy management system for the protection of a user of a centrifuge system. A centrifuge rotor, used to contain the samples, can develop very high energy levels at its rated rotational speed. It can be assumed that substantially all of this energy could be almost instantaneously released in a catastrophic disruption of a centrifuge rotor. Since it is desirable that the energy that is released by the catastrophic disruption of a centrifuge rotor be contained and dissipated, at least to some desired degree, the designer of the centrifuge system calculates the maximum energy level of all of the centrifuge rotors that are used in the centrifuge and designs the containment or protection system to accommodate these rotors. The system is then tested under conditions which produce this maximum energy level. This design and testing process is one way to determine the maximum energy level that can be safely contained in the centrifuge.

Preferably, the system and method limiting the rotational speed of the centrifuge rotor so that the tested containment energy level is not exceeded during centrifuge operation. The maximum torque of the centrifuge drive motor can be used to limit the top speed of a centrifuge rotor. The spinning of the centrifuge rotor creates a drag or air friction torque defined by the following formula:

$$\text{Drag_Torque} = \text{Drag_Coefficient} * (\text{Rotational_Speed})^{1.8}$$

(The drag coefficient is unique to each centrifuge rotor and is a fixed value).

Figure 3:
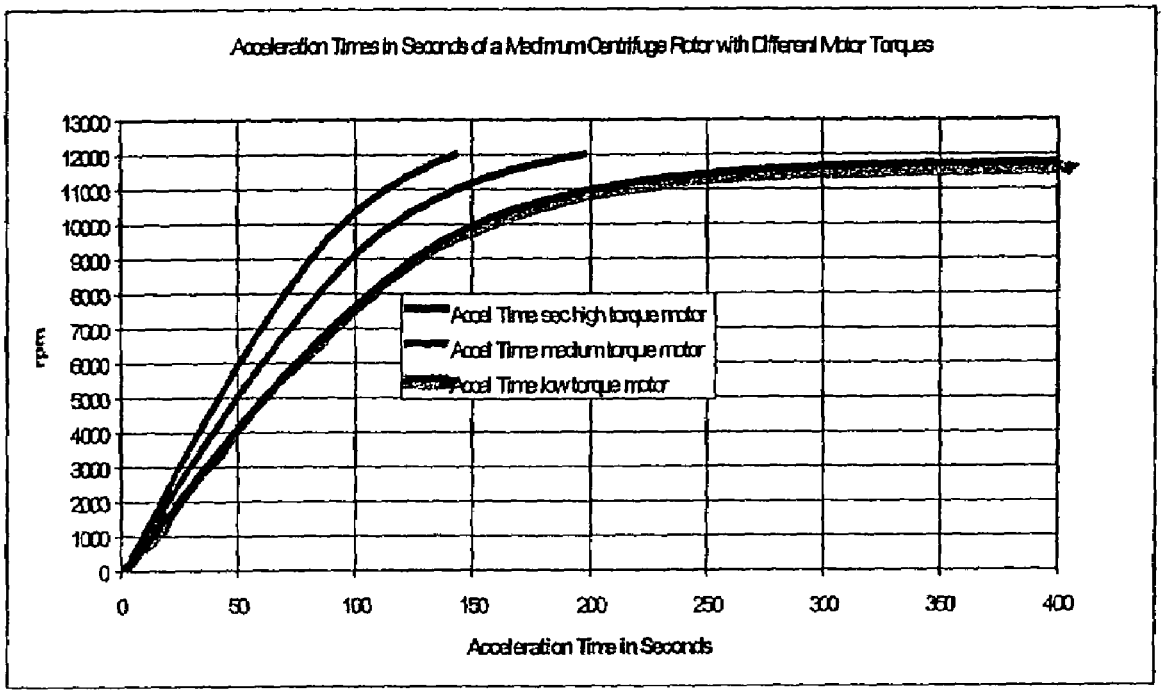
FIG. 3 is a graphical illustration of one preferred embodiment of the present invention showing the acceleration time for a centrifuge rotor with a given drag coefficient with three different motor torque levels.
Figure 4:
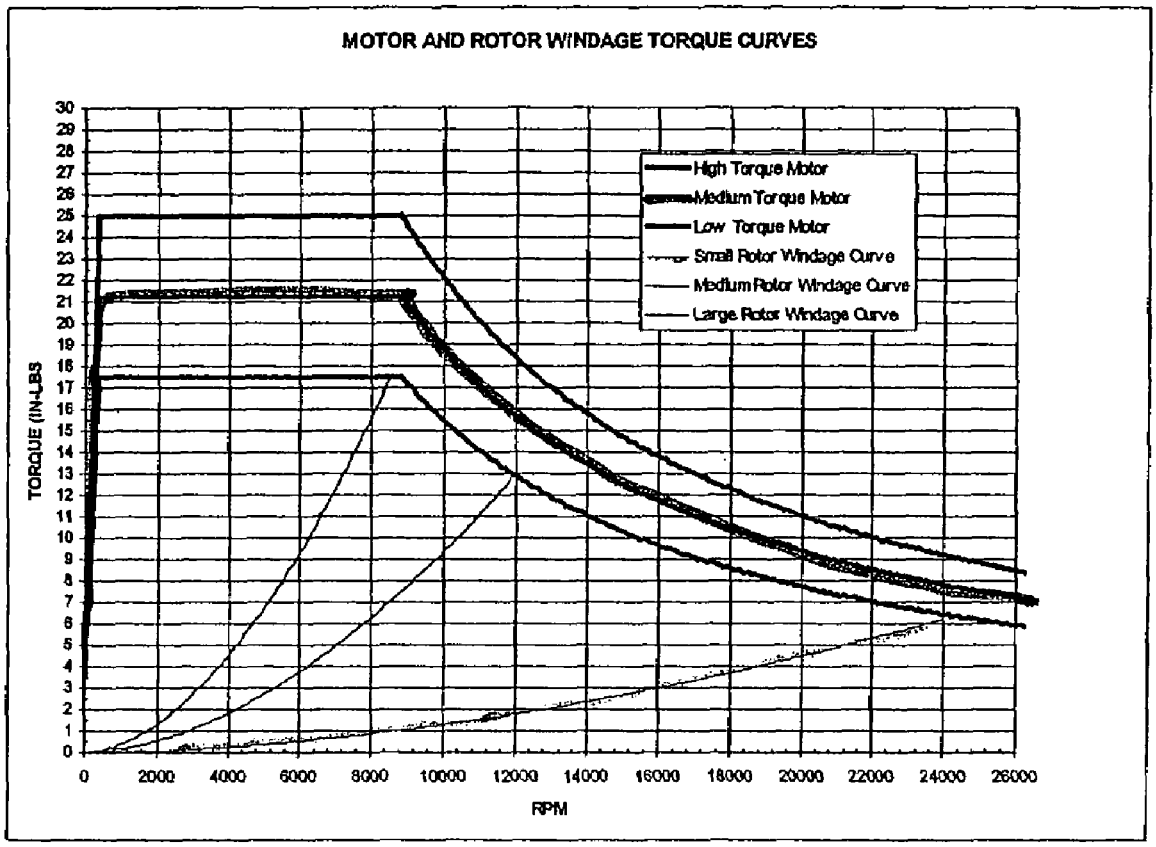
FIG. 4 is a graphical illustration of one preferred embodiment of the present invention showing three different motor torque curves and three different rotor windage torque curves.

This drag torque resists the torque that is developed by the centrifuge motor. When the drag torque equals the motor torque the centrifuge rotor cannot be driven faster, thereby limiting the application of any further energy. FIGS. 3 & 4 illustrate this situation. FIG. 3 shows the acceleration time for a centrifuge rotor with a given drag coefficient with three different motor torque levels. FIG. 4 shows the three different motor torque curves and three different rotor windage torque curves.

As can be seen by FIG. 3 for the medium centrifuge rotor, if the motor torque is kept low to limit the top speed, in this instance to approximately 12,000 rpm, the acceleration time is relatively long. However, if a high torque motor is used the acceleration time is significantly reduced, but as shown in FIG. 2 the rotor can be driven above its 12,000 rpm limit to 13,300 rpm. This increase in speed would result in a 23% increase in energy, which would exceed the predetermined energy limit for this centrifuge and rotor construction.

Some preferred embodiments provide desirable acceleration time without exceeding the predetermined energy containment limit of the centrifuge. The processor then compares the energy level at set speed to the predetermined proven energy containment level of the centrifuge and/or the energy range for the set rotor. If it is determined that the energy level of the rotor at set speed is at or below the containment level of the centrifuge and within the expected energy range for the set rotor, then, a test run may be allowed. If the energy level of the rotor is above the containment level of the centrifuge or outside the expected energy range for the set rotor, the run is terminated and an error is declared, or the speed is automatically reduced to a level that will not exceed the containment level. In another preferred embodiment, the energy management system sets an energy shut down limit below the containment limit of the centrifuge to allow a factor of safety. In a preferred embodiment, the factor of safety would be set to approximately 12 to 15% below the containment limit.

The energy management system of the present invention preferably will not allow any rotor to be driven past the proven predetermined containment limit of the instrument. For example, the system measures the kinetic energy of the installed rotor at, for example, 4300 rpm and calculates what the kinetic energy would be when the rotor reaches the user set speed. If the calculated kinetic energy is greater than the proven predetermined containment limit of the system, the run is terminated, or the speed is automatically reduced.

The energy of the rotor is preferably calculated during acceleration by making one or more of a series of calculations. For example, the deceleration rate of the rotor while momentarily coasting at a prescribed rpm value is measured. An acceleration rate of the rotor is also calculated under a known torque at another prescribed rpm value. The acceleration rate is measured by determining the speed change in a given time when the applied torque is accelerating the rotor. The deceleration rate is measured by determining the speed change in a given time when the applied torque is removed and the rotor is coasting. For instance, a deceleration rate of the rotor may be measured while the rotor is momentarily coasting at 4100 rpm. An acceleration rate of the rotor may be measured under a known torque at 4300 rpm. The deceleration rate at 4100 rpm is multiplied by 0.909 to adjust the rate to 4,300 rpm. Using both the acceleration rate and the deceleration rate, the rotor windage torque (or drag torque) factors out of the equation. It should be noted that the 4100 and 4300 rpm speeds are for example only. Any set of speed values can be used during acceleration and/or deceleration.

Hence, in this example the calculated kinetic energy at the set speed is calculated by the following formula:

$$\text{Kinetic_Energy @ set speed} = 0.5*(\text{Ta—Inertia}_{13}\text{ Drive}*(\text{Acceleration Rate}+\text{Deceleration rate}))/(\text{Acceleration Rate}+\text{Deceleration rate})*\text{Speed_Set}^2$$

Inertia_Drive is the inertia of the motor rotor, coupling, gyro shaft and drive cone. This value is a fixed value determined by design or experimentation.

The system torque or applied torque, Ta, is calculated from a current C applied to the motor multiplied by a torque constant $K_T$ of the motor as shown by following formula:

$$Ta = CK_T$$

(The torque applied by the motor is in-lbs).

The calculated kinetic energy at set speed can be checked against the maximum containment energy for the centrifuge. If the rotor kinetic energy is greater than the maximum containment energy for the centrifuge, the run will be shut down or automatically run at a lower speed. However, if the kinetic energy is below the maximum containment energy of the centrifuge, the run will be allowed at the speed set on the centrifuge. Also if the kinetic energy is outside the expected energy range for the set rotor, the run will be shut down or automatically run at a lower speed. However, if the kinetic energy is within expected energy range for the set rotor, the run will be allowed at the speed set on the centrifuge.

The design and testing will set the maximum energy level that can be safely contained in the centrifuge. For instance, if an operator misidentifies the proper rotor name to the input systems of the centrifuge, the centrifuge system will determine the maximum energy that the centrifuge rotor will develop and, thus, operate accordingly. By way of example, a large rotor could be identified as a small rotor. In this instance, the large rotor could ordinarily be driven to a speed and achieve a maximum energy value past the maximum containment energy of the centrifuge. However, by determining the maximum energy of the centrifuge rotor and knowing the proven maximum containment energy of the centrifuge in accordance with the present invention, the centrifuge system may accommodate for such errors.

For example, a user may put in ROTOR A (a large rotor with a maximum speed of 9,000 RPM) in the centrifuge and mistakenly set the rotor identification as ROTOR B (a small rotor with a maximum speed of 13,000 RPM) while setting the speed of the centrifuge to 11,000 RPM. In this example, ROTOR A has a maximum speed of 9,000 RPM. If ROTOR A were driven at the set speed of the centrifuge, i.e., 11,000 RPM, ROTOR A would be exposed to a higher stress level and risk a greater possibility of failure. At 11,000 RPM, ROTOR A develops between 126,000 to 157,000 ft-lb of kinetic energy. In this example, the proven containment level of the centrifuge is assumed to be 160,000 ft-lb. At this energy level, the run would be allowed, because the maximum kinetic energy of ROTOR A (157,000 ft-lb) is below the proven containment level of the centrifuge (160,000 ft-lb). Thus, in accordance with the present invention, the centrifuge system would compare the energy range for ROTOR B at 11,000 RPM (78,000 to 105,000 ft-lb). The range of ROTOR A is above the 105,000 ft-lb maximum for ROTOR B. Therefore, the centrifuge system would declare a fault and either terminate the centrifuge run or limit the applied torque to ROTOR A to limit the speed that ROTOR A could be run at and, hence, limit the energy level of ROTOR A. Additionally, if the speed was set to 13,000 rpm (instead of 11,000 rpm) the energy that would be calculated is 175,938 to 219,280 ft-lbs. This energy level would exceed the proven containment limit of the centrifuge of 160,000 ft-lbs. At this point, a fault would be declared and the run would be terminated or the speed would be automatically reduced.

The formulas described herein are by way of example only. Other equations may be employed depending, for example, on how the pertinent data is measured.

The many features and advantages of the invention are apparent from the detailed specification, and thus, it is intended by the appended claims to cover all such features and advantages of the invention which fall within the true spirits and cope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A method of centrifuge energy management, comprising the steps of:

calculating a projected energy level of a centrifuge rotor at a predetermined set speed based upon the measuring of an deceleration rate of the rotating centrifuge rotor;

comparing the calculated energy level to an energy range of a set centrifuge rotor; and terminating a centrifuge run or reducing a rotational speed of the centrifuge rotor if the calculated energy level exceeds the energy range of the set centrifuge rotor.

2. Method of claim 1, wherein the calculated energy level is a projected or expected energy level of the centrifuge rotor at predetermined set speed.

3. Method of claim 1, wherein the energy level of the centrifuge rotor is calculated during acceleration of the centrifuge rotor up to the predetermined set speed by making one or more of a series of calculations.

4. The method of claim 1, wherein the deceleration rate of the centrifuge rotor is measured while the centrifuge rotor is momentarily coasting at a speed value or at speed values which is/are lower then predetermined set speed.

5. The method of claim 1, wherein the deceleration rate of the centrifuge rotor is measured by determining the speed change in a given time when an applied torque to the rotating centrifuge rotor is removed and the centrifuge rotor is coasting.

6. The method of claim 1, wherein calculating of the energy level of the centrifuge rotor further based upon measuring of an acceleration rate of the centrifuge rotor.

7. The method of claim 6, wherein the acceleration rate of the centrifuge rotor is measured by determining the speed change in a given time when the applied torque to the centrifuge rotor is accelerating the centrifuge rotor.

8. The method of claim 7, wherein the deceleration rate and the acceleration rate of the centrifuge rotor are measured at different speed values.

9. The method of claim 6, wherein the acceleration rate of the centrifuge rotor is measured at a speed value or at speed values which is/are lower then the predetermined set speed.

10. Method of claim 1, wherein the calculation of the energy level of the centrifuge rotor includes removing an effect of an inertia of a drive mechanism.

11. Method of claim 1, wherein the projected energy level is calculated according to $$\text{Kinetic} - \text{Energy} = \frac{x[Ta - \text{Inertia} - \text{Drive} \times (\text{Acceleration Rate} + \text{Deceleration Rate})]}{(\text{Acceleration Rate} + \text{Deceleration Rate}) \times \text{Speed} - \text{Set}^2}$$

where Kinetic_Energy is the projected energy level at the set speed; Ta is the applied torque; Inertia_Drive is the inertia of the motor, centrifuge rotor, coupling, gyro shaft and drive cone; Acceleration Rate is an acceleration rate of said centrifuge rotor at a first prescribed rotational speed with a known applied torque; and Deceleration Rate is a deceleration rate of said centrifuge rotor at a second prescribed rotational speed with no applied torque.

12. The method of claim 1, wherein the set speed is based on a user input speed setting.

13. The method of claim 1, wherein the calculation of the energy level comprises one or more of a series of calculations.

14. The method of claim 1, further comprising:

allowing a centrifuge run if said energy level of the centrifuge rotor does not exceed said energy range of the set centrifuge rotor.

15. The method of claim 1, further comprising:

automatically reducing the rotational speed of the centrifuge rotor.

16. The method of claim 1, wherein instead of determining the energy level of the centrifuge rotor at the predetermined speed a kinetic energy value is determined.

17. The method of claim 1, wherein the calculated energy level is further compared with a predetermined maximum containment level for the centrifuge and the centrifuge run is terminated or the rotational speed of the centrifuge rotor is reduced if the calculated energy level exceeds the predetermined maximum containment level.

18. The method of claim 17, wherein an energy shutdown limit corresponds to a predetermined maximum containment level of the centrifuge.

19. The method of claim 17, wherein the energy shutdown limit corresponds to an energy level below the predetermined maximum containment level in order to provide for a factor of safety.

20. The method of claim 19, wherein the energy shutdown limit corresponds to an energy level approximately twelve to fifteen percent below the predetermined maximum containment level.

21. A method of centrifuge energy management, comprising:

calculating a projected (kinetic) energy level of a centrifuge rotor at a predetermined set speed based upon the measuring of a deceleration rate of the rotating centrifuge rotor;

comparing the calculated energy level to a predetermined maximum containment energy level for the centrifuge system; and terminating a centrifuge run or reducing a rotational speed of the centrifuge rotor when the calculated energy level exceeds an energy level approximately twelve or fifteen percent below the predetermined containment energy level.

22. A method of centrifuge energy management, comprising:

initializing by inserting a rotor, setting a rotor identification, and setting the rotor speed to a predetermined set speed for a rotor run;

measuring of a kinetic energy of the installed rotor by measuring the deceleration rate while coasting at a prescribed rotation speed;

calculating what the kinetic energy would be, when the rotor reaches the predetermined set speed;

comparing when the calculated kinetic energy at the predetermined set speed is outside of the expected energy range for the set rotor;

terminating the run or speed or automatically reducing the speed when the calculated kinetic energy is greater than expected energy; and allowing rotor run at set speed when the calculated kinetic energy is lower than the expected energy.

* * * * *

UNITED STATES PATENT AND TRADEMARK OFFICE

CERTIFICATE OF CORRECTION

PATENT NO. : 7,458,928 B2
APPLICATION NO. : 10/441120
DATED : December 2, 2008
INVENTOR(S) : David M. Carson et al.

It is certified that error appears in the above-identified patent and that said Letters Patent is hereby corrected as shown below:

In column 2, line 20, change "to not exceed this limit valve." to --to not exceed this limit value.--.

In column 4, line 35, change "Preferably, the system and method limiting the rotational speed" to --Preferably, the system and method limit the rotational speed--.

In column 4, line 43, change

"Drag_Torque = Drag_Coefficient * (Rotational_Speed)
1.8"

to

--Drag_Torque = Drag_Coefficient * $(\text{Rotational_Speed})^{1.8}$--, as shown in the Specification at Page 10, line 4.

In column 5, line 49, change

"Kinetic_Energy @ set speed = 0.5 * (Ta – $\text{Inertia}_{13}$ Drive *"

to

--Kinetic_Energy @ set speed = 0.5 * (Ta – Inertia_Drive *-- as shown in the Specification at Page 13, line 1.

In column 6, line 54, change "and thus, it is intended" to --and thus it is intended--.

In column 6, line 57, change "spirits and cope" to --spirit and scope--.

In claim 1, column 7, line 3, change "an deceleration rate" to --a deceleration rate--.

Signed and Sealed this

Twenty-third Day of February, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,458,928 B2
APPLICATION NO. : 10/441120
DATED : December 2, 2008
INVENTOR(S) : David M. Carson et al.

It is certified that error appears in the above-identified patent and that said Letters Patent is hereby corrected as shown below:

In column 2, line 20, change "to not exceed this limit valve." to --to not exceed this limit value.--.

In column 4, line 35, change "Preferably, the system and method limiting the rotational speed" to --Preferably, the system and method limit the rotational speed--.

In column 4, line 43, change
"Drag_Torque = Drag_Coefficient * (Rotational_Speed)
1.8"
to
--Drag_Torque = Drag_Coefficient * $(\text{Rotational_Speed})^{1.8}$--,
as shown in the Specification at Page 10, line 4.

In column 5, line 49, change
"Kinetic_Energy @ set speed = 0.5 * (Ta – $\text{Inertia}_{13}$ Drive *"
to
--Kinetic_Energy @ set speed = 0.5 * (Ta – Inertia_Drive *--
as shown in the Specification at Page 13, line 1.

In column 6, line 54, change "and thus, it is intended" to --and thus it is intended--.

In column 6, line 57, change "spirits and cope" to --spirit and scope--.

In claim 1, column 7, line 3, change "an deceleration rate" to --a deceleration rate--.

In claim 4, column 7, line 19, change "which is/are lower then predetermined set speed." to --which is/are lower than the predetermined set speed.--.

In claim 6, column 7, line 26, change "energy level of the centrifuge rotor further based upon measuring" to --energy level of the centrifuge rotor is further based upon measuring--.

This certificate supersedes the Certificate of Correction issued February 23, 2010.

Signed and Sealed this

Nineteenth Day of October, 2010

David J. Kappos

David J. Kappos
*Director of the United States Patent and Trademark Office*

In claim 9, column 7, line 37, change “which is/are lower then the predetermined set speed.” to --which is/are lower than the predetermined set speed.--.